US008113582B2

(12) United States Patent
Liu

(10) Patent No.: US 8,113,582 B2
(45) Date of Patent: Feb. 14, 2012

(54) CHAIR CUSHION

(76) Inventor: Huang Chang Liu, Changhua County (TW)

( * ) Notice: Subject to any disclaimer, the term of this patent is extended or adjusted under 35 U.S.C. 154(b) by 292 days.

(21) Appl. No.: 12/488,517

(22) Filed: Jun. 20, 2009

(65) Prior Publication Data

US 2009/0309399 A1 Dec. 17, 2009

(51) Int. Cl.
*A47C 7/02* (2006.01)

(52) U.S. Cl. ..... 297/230.12; 297/230.13; 297/284.4; 297/452.31

(58) Field of Classification Search ..... 297/230.12, 297/230.13, 284.4, 284.5, 452.28, 452.31, 297/452.29, 452.36, 452.42, 452.43, 452.46, 297/452.55, 452.57
See application file for complete search history.

(56) References Cited

U.S. PATENT DOCUMENTS

| | | | | | |
|---|---|---|---|---|---|
| 371,402 | A | * | 10/1887 | Williamson | 297/169 |
| 646,290 | A | * | 3/1900 | Kratz | 297/452.31 |
| 2,893,476 | A | * | 7/1959 | Liljengren | 297/300.5 |
| 3,361,471 | A | * | 1/1968 | Radford | 297/230.12 |
| 3,454,302 | A | * | 7/1969 | Radford | 297/230.12 |
| 3,512,835 | A | * | 5/1970 | Flototto | 297/452.14 |
| 3,758,159 | A | * | 9/1973 | Morris | 297/452.14 |
| 4,350,388 | A | * | 9/1982 | Weiner | 297/284.7 |
| 4,535,495 | A | | 8/1985 | Oldfield | |
| 4,556,254 | A | * | 12/1985 | Roberts | 297/452.36 |
| 4,810,034 | A | | 3/1989 | Beier | |
| 5,553,917 | A | * | 9/1996 | Adat et al. | 297/230.14 |
| 5,573,302 | A | * | 11/1996 | Harrison et al. | 297/230.14 |
| 5,580,124 | A | * | 12/1996 | Dellanno | 297/216.12 |
| 5,997,094 | A | * | 12/1999 | Cvek | 297/452.15 |
| 6,409,268 | B1 | * | 6/2002 | Cvek | 297/452.29 |
| 6,626,497 | B2 | * | 9/2003 | Nagamitsu et al. | 297/452.15 |
| 6,880,215 | B2 | * | 4/2005 | Peterson | 29/91.1 |
| 6,928,829 | B2 | * | 8/2005 | Kamiya et al. | 62/244 |
| 7,303,230 | B2 | * | 12/2007 | Munn et al. | 297/255 |
| 7,455,365 | B2 | * | 11/2008 | Caruso et al. | 297/452.46 |
| 7,604,299 | B2 | * | 10/2009 | Su | 297/452.18 |
| 2002/0043842 | A1 | * | 4/2002 | Nakamori | 297/284.5 |
| 2003/0047982 | A1 | * | 3/2003 | Ball et al. | 297/452.29 |
| 2004/0100139 | A1 | * | 5/2004 | Williams | 297/452.31 |
| 2009/0140568 | A1 | * | 6/2009 | Chan et al. | 297/452.11 |
| 2009/0146476 | A1 | * | 6/2009 | Kan et al. | 297/284.4 |
| 2010/0001572 | A1 | * | 1/2010 | Masunaga et al. | 297/452.29 |

FOREIGN PATENT DOCUMENTS

| | | | | |
|---|---|---|---|---|
| CA | 1198232 | A2 | | 12/1985 |
| DE | 4320382 | A1 | * | 12/1994 |
| EP | 420370 | A1 | * | 4/1991 |
| EP | 0423078 | A1 | | 4/1991 |
| EP | 536868 | A1 | * | 4/1993 |
| FR | 2613603 | A3 | * | 10/1988 |
| GB | 151474 | | | 9/1920 |
| GB | 2400313 | A | | 10/2004 |

* cited by examiner

*Primary Examiner* — David Dunn
*Assistant Examiner* — David E Allred
(74) *Attorney, Agent, or Firm* — Chi IP Law Firm

(57) ABSTRACT

A cushion for a chair includes a cushion body (20) having a mediate position provided with a convex waist support portion (21), an upper end provided with an inclined backrest support portion (22) and a lower end provided with a concave resting portion (24). Thus, the backrest support portion and the waist support portion of the cushion body are designed to fit the user's back and waist ergonomically so that the cushion body can support the user's back and waist smoothly and exactly. In addition, the upper buffering space (202) and the lower buffering space (201) of the cushion body provide a buffering effect to allow deformation of the cushion body so as to regulate the user's seating posture and to provide a comfortable sensation to the user.

12 Claims, 12 Drawing Sheets

PRIOR ART

PRIOR ART

CHAIR CUSHION

FIELD OF THE INVENTION

The present invention generally relates to a cushion and, more particularly, to a cushion for a chair.

BACKGROUND OF THE INVENTION

A conventional cushion 10 for a chair in accordance with the prior art shown in FIGS. 11 and 12 comprises a cushion body 11 and two fasteners 12 mounted on a rear face of the cushion body 11. Thus, when the cushion is placed on a seat, the cushion body 11 can support a user's rear body to provide a comfortable sensation to the user. However, the cushion body 11 can support the user's waist only and cannot support the user's back so that the user's back is suspended in the air. Thus, the user's back easily feels uncomfortable and is easily deformed during a long-term utilization.

SUMMARY OF THE INVENTION

In accordance with the present invention, there is provided a cushion for a chair, comprising a cushion body having a mediate position provided with a convex waist support portion, an upper end provided with an inclined backrest support portion located above the waist support portion and a lower end provided with a concave resting portion located under the waist support portion. Preferably, the cushion body has a surface provided with a plurality of elongate slots. Preferably, the cushion body is provided with a concave upper buffering space defined between the backrest support portion and the waist support portion of the cushion body and a concave lower buffering space defined between the waist support portion and the resting portion of the cushion body. Preferably, the waist support portion of the cushion body has two opposite sides each provided with an enlarged reinforced face.

Another embodiment of the present invention is to provide a cushion for a chair, wherein the backrest support portion and the waist support portion of the cushion body are designed to fit the user's back and waist ergonomically so that the cushion body can support the user's back and waist smoothly and exactly.

A further embodiment of the present invention is to provide a cushion for a chair, wherein the upper buffering space and the lower buffering space of the cushion body provide a buffering effect to allow deformation of the cushion body so as to regulate the user's seating posture and to provide a comfortable sensation to the user.

A further aspect of the present invention is to provide a cushion for a chair, wherein the elongate slots of the cushion body provide a ventilating effect to the user.

An alternative aspect of the present invention is to provide a cushion for a chair, wherein the reinforced face of the waist support portion supports the user's waist smoothly and exactly so as to provide a comfortable sensation to the user.

Additional aspect of the present invention is to provide a cushion for a chair, wherein the cushion body is made of an elastic sheet plate so that the cushion body has a smaller volume and a lighter weight, thereby decreasing the costs of fabrication.

In accordance with one exemplary embodiment, a cushion for a chair includes a cushion body (20) having a mediate position provided with a convex waist support portion (21). The cushion further includes an upper end provided with an inclined backrest support portion (22) located above the waist support portion and a lower end provided with a concave resting portion (24) located under the waist support portion.

Further benefits and advantages of the present invention will become apparent after a careful reading of the detailed description with appropriate reference to the accompanying drawings.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF EMBODIMENTS OF THE INVENTION

Figure 1:
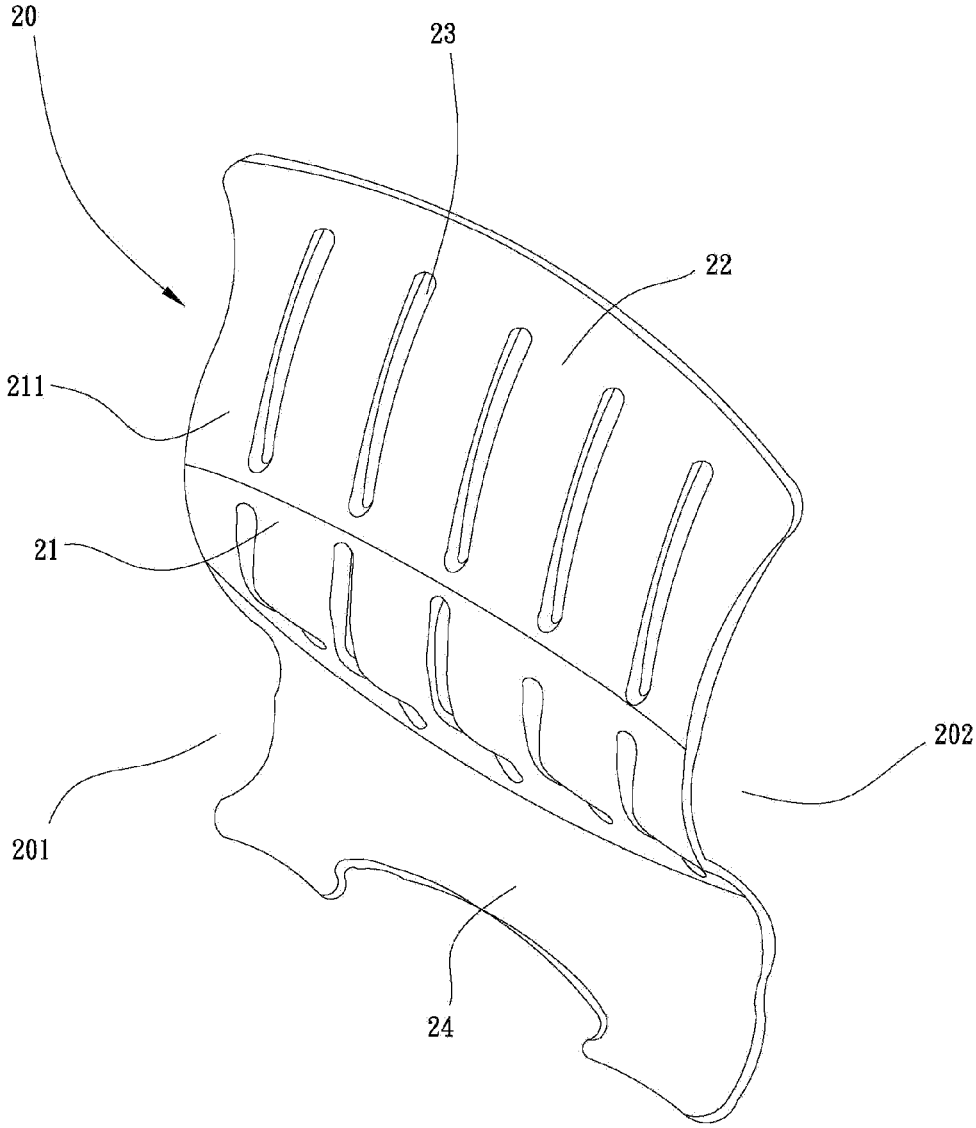
FIG. 1 is a perspective view of a cushion for a chair in accordance with the preferred embodiment of the present invention.
Figure 2:
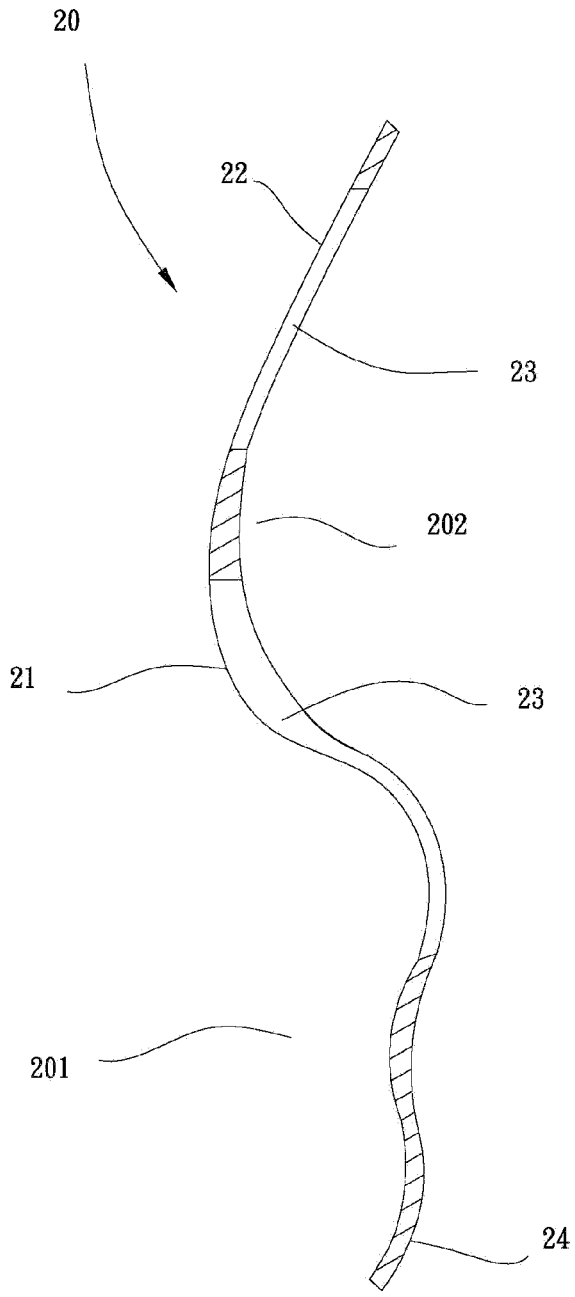
FIG. 2 is a side cross-sectional view of the cushion for a chair as shown in FIG. 1.

Referring to the drawings and initially to FIGS. 1 and 2, a cushion for a chair in accordance with the preferred embodiment of the present invention comprises a cushion body 20 having a mediate position provided with a convex waist support portion 21, an upper end provided with an inclined backrest support portion 22 located above the waist support portion 21 and a lower end provided with a concave resting portion 24 located under the waist support portion 21.

The cushion body 20 is made of an elastic sheet plate. The cushion body 20 has a surface provided with a plurality of elongate slots 23 which are parallel with each other and extend in a longitudinal direction of the cushion body 20. The elongate slots 23 of the cushion body 20 are located at the backrest support portion 22 and the waist support portion 21 of the cushion body 20. In the preferred embodiment of the present invention, the elongate slots 23 on the backrest support portion 22 of the cushion body 20 are separated from the elongate slots 23 on the waist support portion 21 of the cushion body 20.

The cushion body 20 is provided with a concave upper buffering space 202 defined between the backrest support portion 22 and the waist support portion 21 of the cushion body 20 and a concave lower buffering space 201 defined between the waist support portion 21 and the resting portion 24 of the cushion body 20. The upper buffering space 202 and the lower buffering space 201 of the cushion body 20 are located at two opposite faces of the cushion body 20 and are opened toward two opposite directions.

The waist support portion 21 of the cushion body 20 is a substantially arc-shaped sheet plate. The waist support portion 21 of the cushion body 20 is located between the backrest support portion 22 and the resting portion 24 of the cushion body 20 and has two opposite sides each provided with an enlarged reinforced face 211. The waist support portion 21 of the cushion body 20 has a thickness gradually increased from a middle position of the waist support portion 21 toward each of the two opposite sides of the waist support portion 21.

The backrest support portion 22 of the cushion body 20 is a substantially straight flat sheet plate. The backrest support portion 22 of the cushion body 20 is inclined relative to the waist support portion 21 of the cushion body 20 and extends upward and backward from an upper end of the waist support portion 21 in an inclined manner.

The resting portion 24 of the cushion body 20 is a substantially arc-shaped sheet plate. The resting portion 24 of the cushion body 20 has an upper end inclined relative to the waist support portion 21 of the cushion body 20 and extending downward and backward from a lower end of the waist support portion 21 in an inclined manner.

Figure 3:
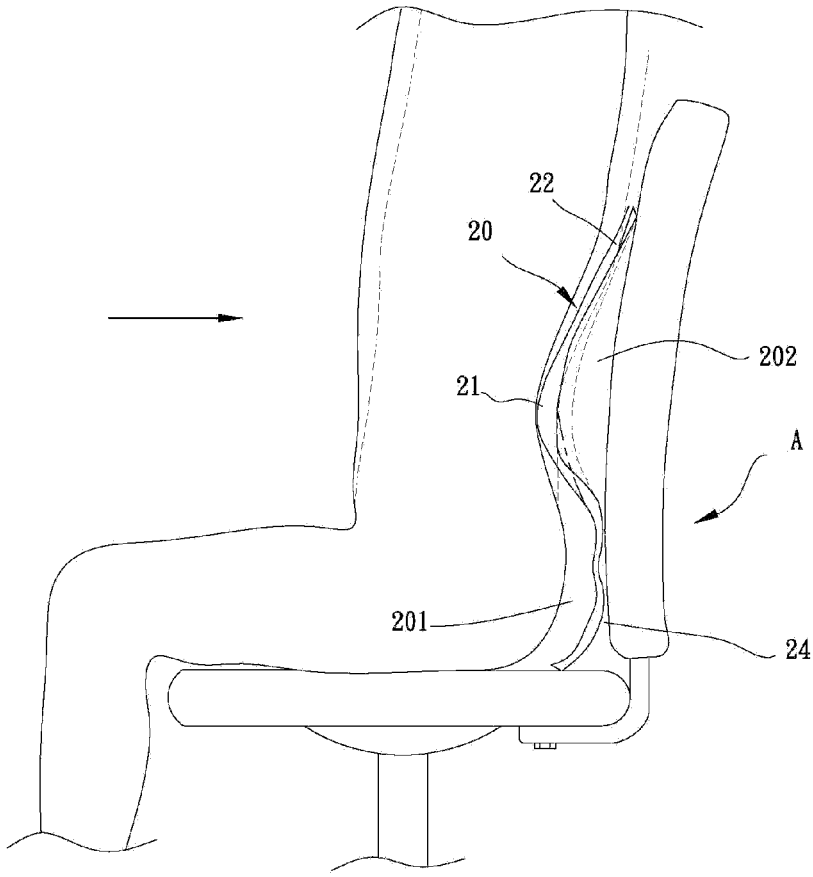
FIG. 3 is a schematic operational view of the cushion for a chair as shown in FIG. 2 in use.

In operation, referring to FIG. 3 with reference to FIGS. 1 and 2, the cushion body 20 is mounted on an office seat "A". In such a manner, when a user is seated on the office chair "A" and rests on the cushion body 20, the backrest support portion 22 of the cushion body 20 can support the pressure of the user's back, and the waist support portion 21 of the cushion body 20 can support the pressure of the user's waist, so that the cushion body 20 can support the user's back and waist smoothly and exactly. At this time, the upper buffering space 202 and the lower buffering space 201 of the cushion body 20 provide a buffering effect to allow deformation of the cushion body 20 so as to regulate the user's seating posture and to provide a comfortable sensation to the user. In addition, the elongate slots 23 of the cushion body 20 provide a ventilating effect to the user. In addition, the reinforced face 211 of the waist support portion 21 supports the user's waist smoothly and exactly so as to provide a comfortable sensation to the user.

Accordingly, the backrest support portion 22 and the waist support portion 21 of the cushion body 20 are designed to fit the user's back and waist ergonomically so that the cushion body 20 can support the user's back and waist smoothly and exactly. In addition, the upper buffering space 202 and the lower buffering space 201 of the cushion body 20 provide a buffering effect to allow deformation of the cushion body 20 so as to regulate the user's seating posture and to provide a comfortable sensation to the user. Further, the elongate slots 23 of the cushion body 20 provide a ventilating effect to the user. Further, the reinforced face 211 of the waist support portion 21 supports the user's waist smoothly and exactly so as to provide a comfortable sensation to the user. Further, the cushion body 20 is made of an elastic sheet plate so that the cushion body 20 has a smaller volume and a lighter weight, thereby decreasing the costs of fabrication.

Figure 4:
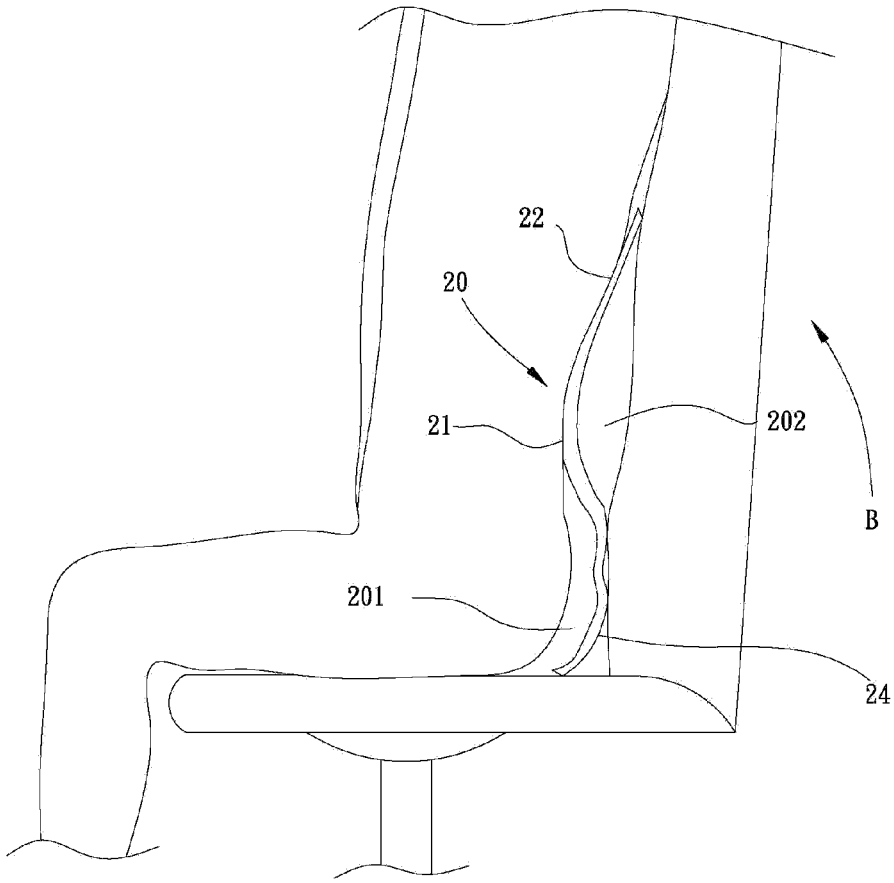
FIG. 4 is a schematic operational view of the cushion for a chair as shown in FIG. 2 in use.

As shown in FIG. 4, the cushion body 20 is mounted on a car seat "B".

Figure 5:
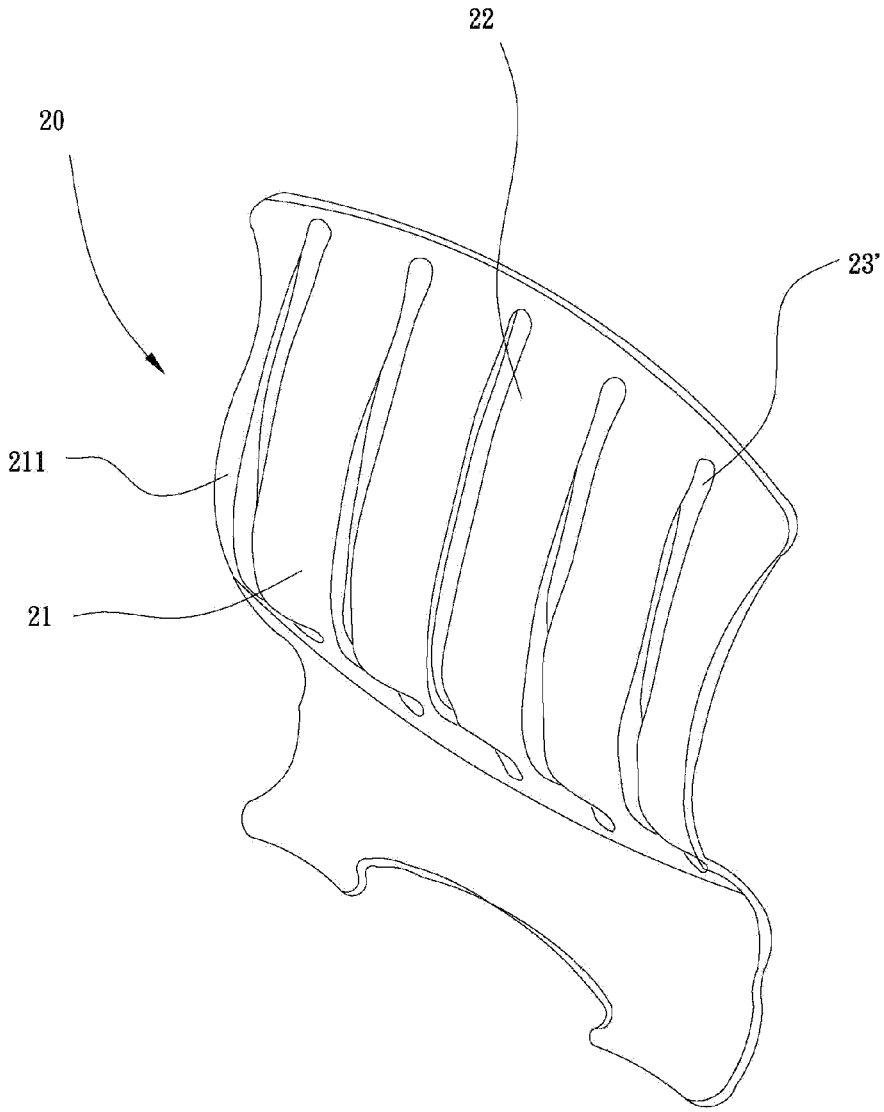
FIG. 5 is a perspective view of a cushion for a chair in accordance with another preferred embodiment of the present invention.

Referring to FIG. 5, the elongate slots 23*a* on the backrest support portion 22 of the cushion body 20*a* and the elongate slots 23*a* on the waist support portion 21 of the cushion body 20*a* are connected so that the elongate slots 23*a* of the cushion body 20*a* extend successively from the backrest support portion 22 of the cushion body 20*a* to the waist support portion 21 of the cushion body 20*a*.

Figure 6:
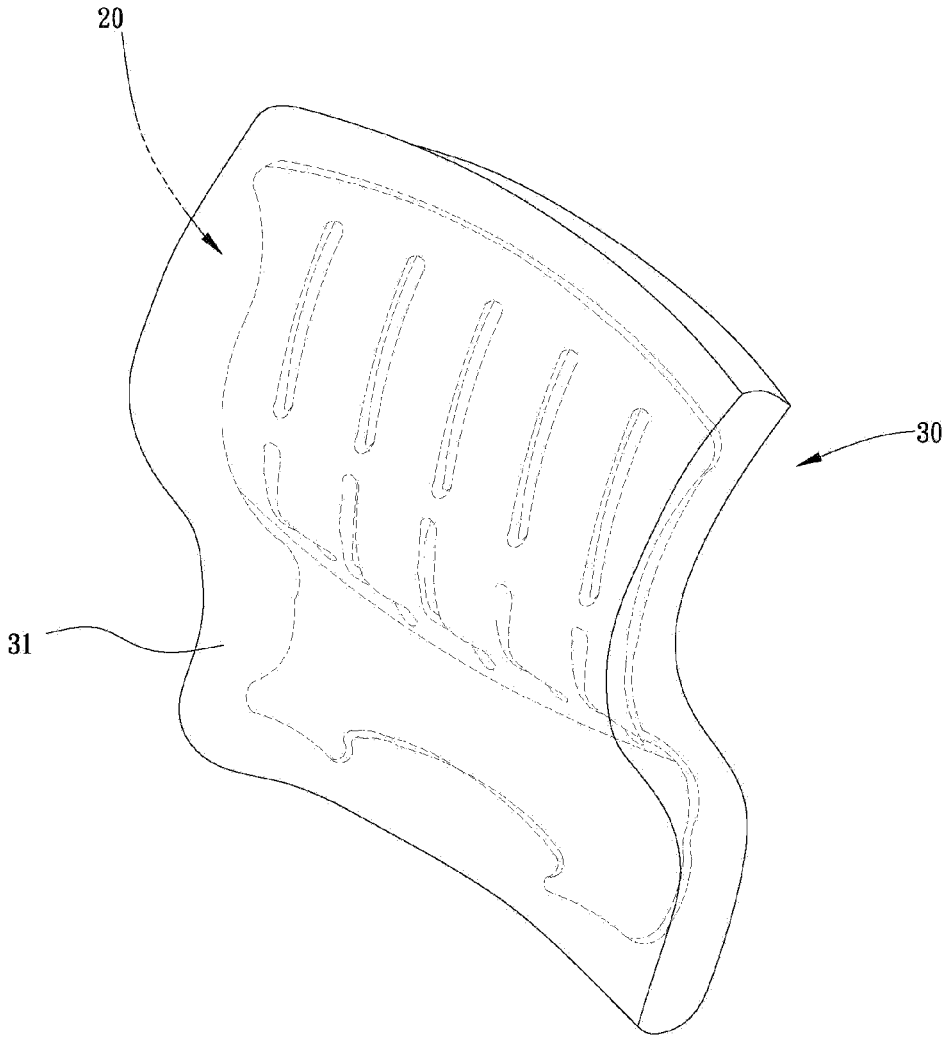
FIG. 6 is a perspective view of a cushion for a chair in accordance with another preferred embodiment of the present invention.
Figure 7:
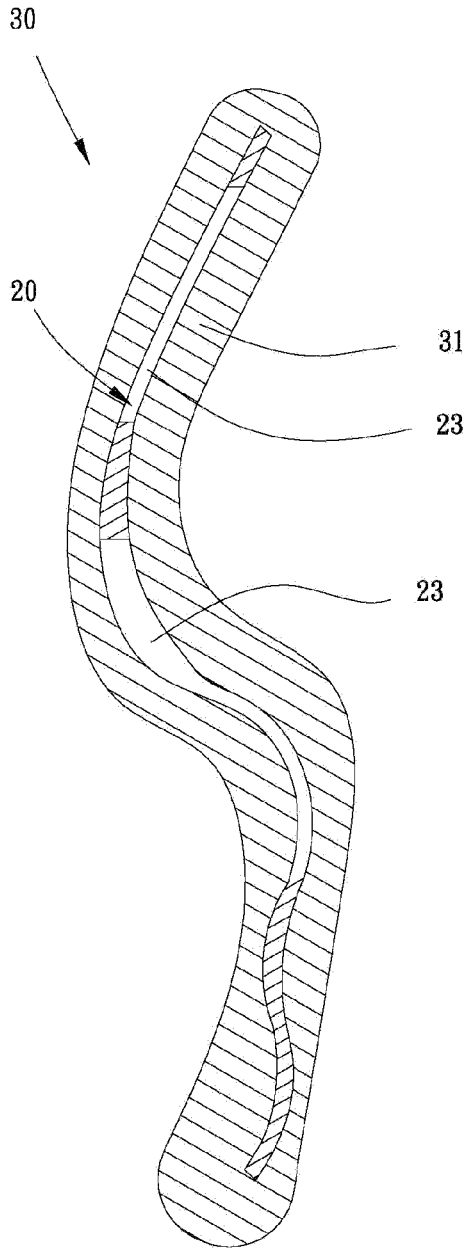
FIG. 7 is a side cross-sectional view of the cushion for a chair as shown in FIG. 6.

Referring to FIGS. 6 and 7, the cushion 30 further comprises an outer jacket 31 encompassing a periphery of the cushion body 20 so that the cushion body 20 is hidden in the outer jacket 31 completely. The outer jacket 31 is made of a sponge or a foam material and has a curvature and profile matching that of the cushion body 20.

Figure 8:
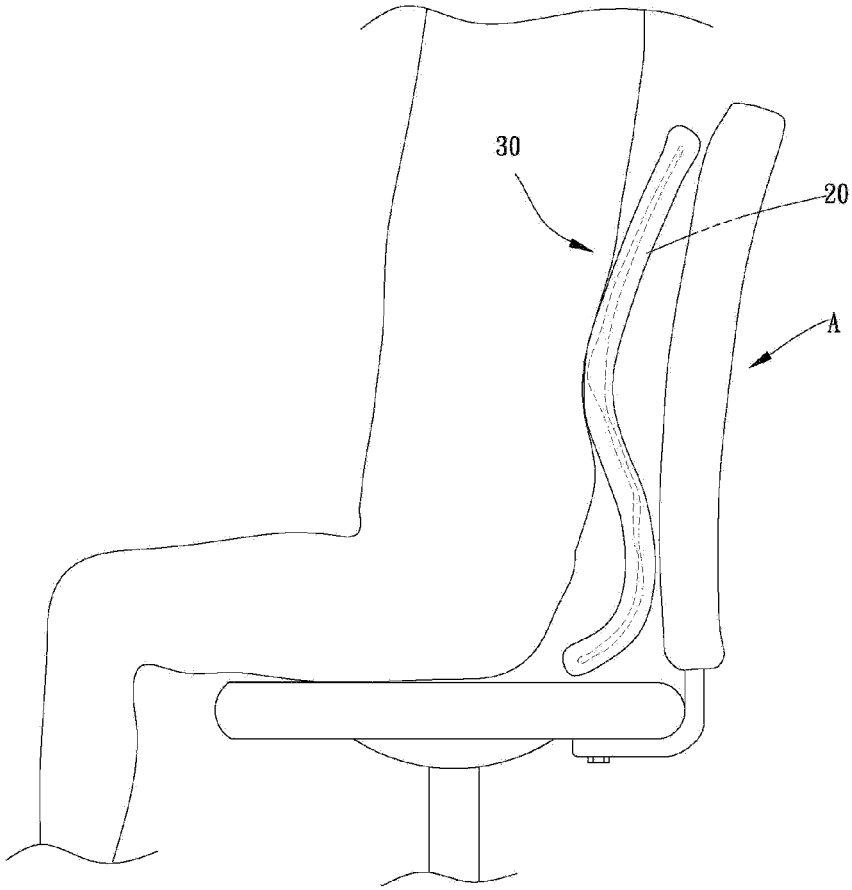
FIG. 8 is a schematic operational view of the cushion for a chair as shown in FIG. 7 in use.
Figure 10:
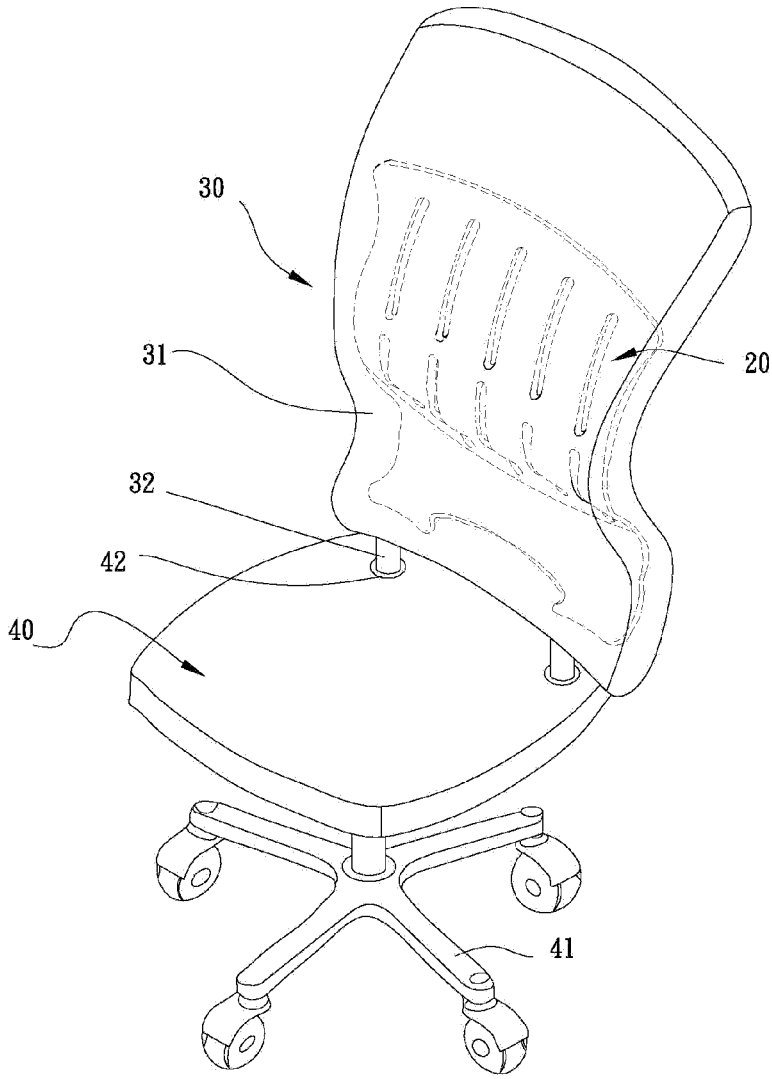
FIG. 10 is a perspective view of a cushion for a chair in accordance with another preferred embodiment of the present invention.

As shown in FIG. 8, the cushion 30 is mounted on an office seat "A" as shown in FIG. 10.

Figure 9:
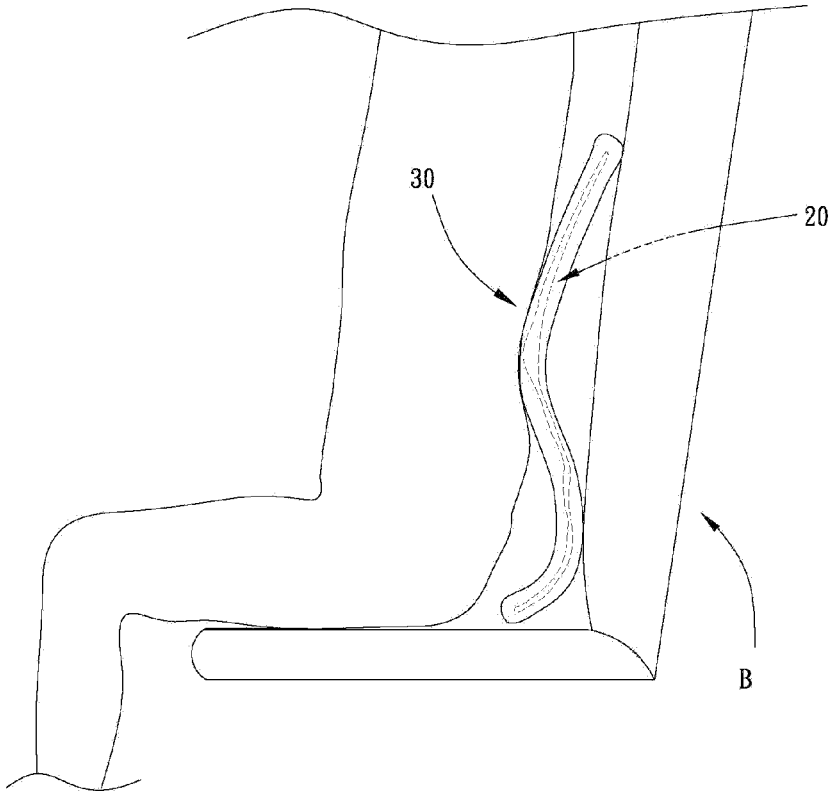
FIG. 9 is a schematic operational view of the cushion for a chair as shown in FIG. 7 in use.
Figure 11:
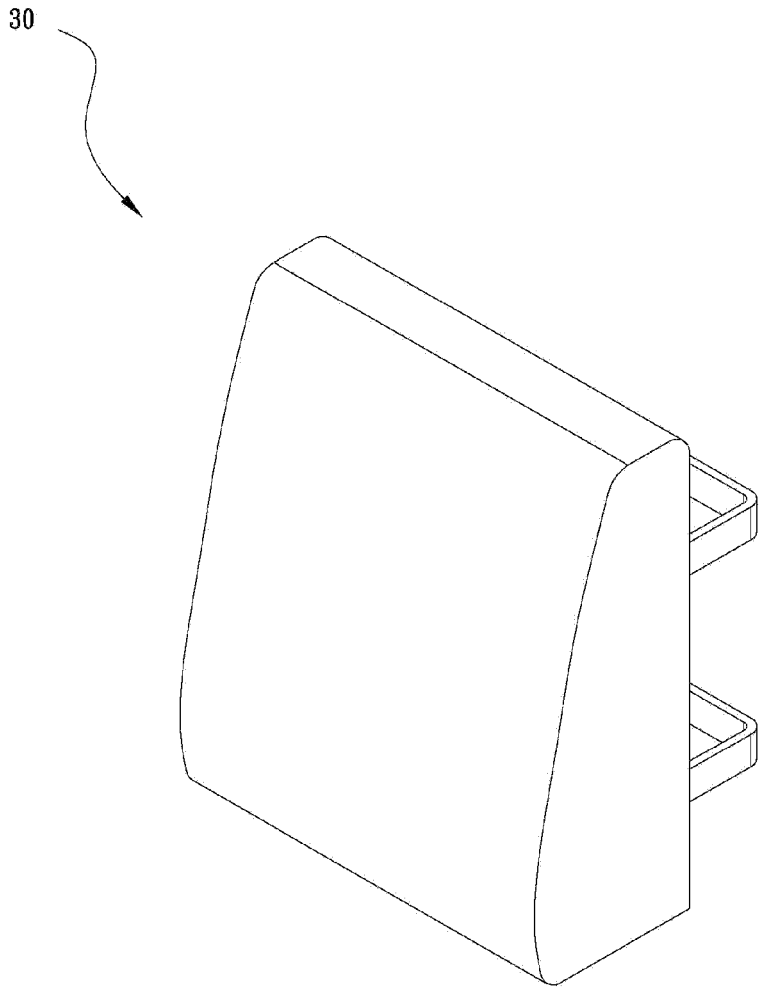
FIG. 11 is a perspective view of a conventional cushion for a chair in accordance with the prior art.
Figure 12:
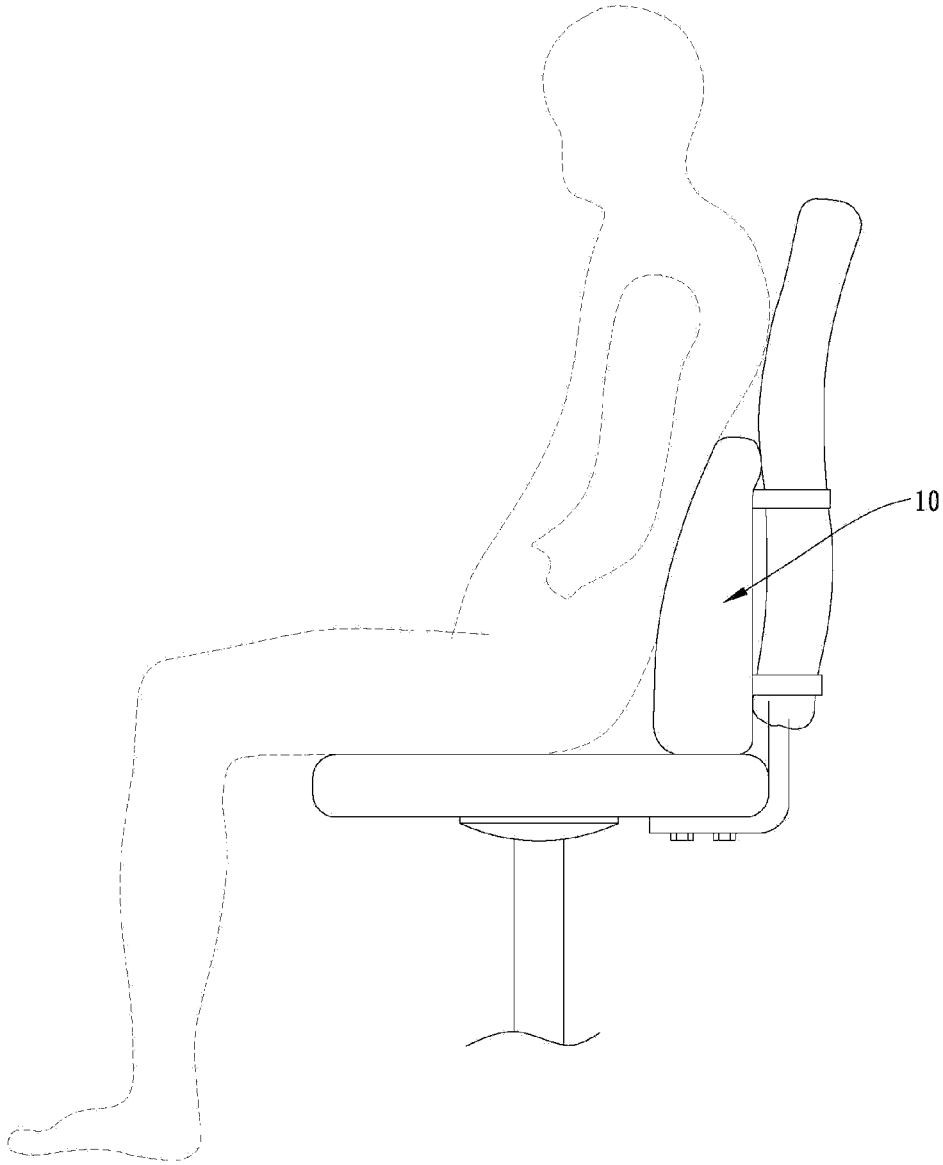
FIG. 12 is a schematic side operational view of the conventional cushion for a chair as shown in FIG. 11 in use.

As shown in FIG. 9, the cushion 30 is mounted on a car seat "B" as shown in FIG. 11.

Referring to FIG. 10, the cushion 30 further comprises a seat 40 combined with the outer jacket 31. The seat 40 has a top provided with two mounting holes 42, and the outer jacket 31 has a bottom provided with two mounting posts 32 mounted in the two mounting holes 42 of the seat 40.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions or products without departing from the scope of the invention, it is intended that all matter contained in the above description and shown in the accompanying drawing[s] shall be interpreted as illustrative and not in a limiting sense.

What is claimed is:

1. A cushion having a jacket of cushioning material surround a cushion body, the cushion being for a chair, the cushion comprising:

the cushion body comprising an elastic sheet plate having a mediate position provided with a convex waist support portion, said cushion body being independent of the chair, said convex waist support portion having a first thickness, an upper end provided with an inclined backrest support portion located above the waist support portion, said inclined backrest support portion having a second thickness, and, a lower end provided with a concave resting portion located under the waist support portion, said concave resting portion having a third thickness, wherein the first thickness of the convex waist support portion is greater than that of the second thickness of the inclined backrest support portion and that of the third thickness of the concave resting portion, wherein the cushion body has a surface provided with a plurality of vertical elongate slots in the waist support portion, wherein the cushion body has a surface provided with a plurality of vertical elongate slots in the backrest support portion, and wherein the vertical elongate slots on the backrest support portion of the cushion body are separated from the vertical elongate slots on the waist support portion of the cushion body by a laterally extending region of the cushion body that is devoid of slots, wherein the laterally extending region extends in a plane completely across the elastic sheet plate at a location between the first thickness and the second thickness so that the backrest support portion and the waist support portion are deformed in response to a seating posture of a user.

2. The cushion for a chair of claim 1, wherein the elongate slots of the cushion body are located at the backrest support portion and the waist support portion of the cushion body.

3. The cushion for a chair of claim 1, wherein the cushion body is provided with a concave upper buffering space defined between the backrest support portion and the waist support portion of the cushion body; the cushion body is provided with a concave lower buffering space defined between the waist support portion and the resting portion of the cushion body, wherein the concave upper buffering space and the concave lower buffering space enable the cushion body to deform and to regulate a seating posture of a user in response to a seating pressure exerted by the user against the waist support portion as the user sits.

4. The cushion for a chair of claim 1, wherein the waist support portion of the cushion body has two opposite sides each provided with an enlarged reinforced face.

5. The cushion for a chair of claim 4, wherein the waist support portion of the cushion body has a thickness gradually increased from a middle position of the waist support portion toward each of the two opposite sides of the waist support portion.

6. The cushion for a chair of claim 2, wherein the elongate slots on the backrest support portion of the cushion body and the elongate slots on the waist support portion of the cushion body are connected; the elongate slots of the cushion body extend successively from the backrest support portion of the cushion body to the waist support portion of the cushion body.

7. The cushion for a chair of claim 1, wherein the cushion body is hidden in the jacket completely; wherein the jacket has a curvature and profile matching that of the cushion body.

8. The cushion for a chair of claim 7, further comprising: a seat combined with the outer jacket; wherein the seat has a top provided with two mounting holes; the outer jacket has a bottom provided with two mounting posts mounted in the two mounting holes of the seat.

9. The cushion for a chair of claim 1, wherein the elongate slots of the cushion body are parallel with each other and extend in a longitudinal direction of the cushion body.

10. The cushion for a chair of claim 1, wherein the waist support portion of the cushion body is a substantially arc-shaped; the backrest support portion of the cushion body has a substantially straight flat shape; the backrest support portion of the cushion body is inclined relative to the waist support portion of the cushion body and extends upward and backward from an upper end of the waist support portion in an inclined manner; and the resting portion of the cushion body is substantially arc-shaped; the resting portion of the cushion body has an upper end inclined relative to the waist support portion of the cushion body and extending downward and backward from a lower end of the waist support portion in an inclined manner.

11. The cushion for a chair of claim 3, wherein the upper buffering space and the lower buffering space of the cushion body are located at two opposite faces of the cushion body and are opened toward two opposite directions; the upper buffering space and the lower buffering space of the cushion body provide a buffering effect to allow deformation of the cushion body.

12. The cushion for a chair of claim 1, wherein the outer jacket is made of a sponge or a foam material.

* * * * *